US010398931B2

(12) United States Patent
Johnston

(10) Patent No.: US 10,398,931 B2
(45) Date of Patent: Sep. 3, 2019

(54) MOVING EXERCISE APPARATUS

(71) Applicant: Gary Lawrence Johnston, Cowarts, AL (US)

(72) Inventor: Gary Lawrence Johnston, Cowarts, AL (US)

( * ) Notice: Subject to any disclaimer, the term of this patent is extended or adjusted under 35 U.S.C. 154(b) by 40 days.

(21) Appl. No.: 15/294,806

(22) Filed: Oct. 17, 2016

(65) Prior Publication Data

US 2018/0104531 A1 Apr. 19, 2018

(51) Int. Cl.

| | |
|---|---|
| ***A63B 22/00*** | (2006.01) |
| ***A63B 21/00*** | (2006.01) |
| ***A63B 23/02*** | (2006.01) |
| ***A63B 23/035*** | (2006.01) |
| ***A63B 21/06*** | (2006.01) |
| *A63B 22/20* | (2006.01) |

(52) U.S. Cl.

CPC ..... *A63B 22/0087* (2013.01); *A63B 21/06* (2013.01); *A63B 21/4035* (2015.10); *A63B 21/4045* (2015.10); *A63B 23/02* (2013.01); *A63B 23/03575* (2013.01); *A63B 22/20* (2013.01); *A63B 2208/0242* (2013.01)

(58) Field of Classification Search

CPC ... A63B 23/02; A63B 23/205; A63B 23/0222; A63B 22/20; A63B 22/201; A63B 22/203; A63B 22/205; A63B 22/208; A63B 22/0087; A63B 22/0089

See application file for complete search history.

(56) References Cited

U.S. PATENT DOCUMENTS

| | | | | | |
|---|---|---|---|---|---|
| 2,733,922 | A * | 2/1956 | Diego | A63B 21/068 | 482/145 |
| 3,797,824 | A * | 3/1974 | Osbourne | A63B 22/203 | 482/132 |
| 3,834,693 | A * | 9/1974 | Poppenberger | A63B 69/18 | 482/146 |
| 4,324,399 | A * | 4/1982 | Rickey | A63B 23/00 | 482/108 |
| 5,360,383 | A * | 11/1994 | Boren | A63B 23/0244 | 482/10 |
| 6,561,957 | B1 * | 5/2003 | Read | A63B 21/012 | 482/94 |
| 2002/0183176 | A1 * | 12/2002 | Read | A63B 22/0007 | 482/148 |
| 2004/0110612 | A1 * | 6/2004 | Read | A63B 22/0007 | 482/142 |

(Continued)

*Primary Examiner* — Nyca T Nguyen

(57) ABSTRACT

A Moving Exercise Apparatus is provided which includes a frame structure member, an intermediate support member, a user support member, and a track guide member. The intermediate support member moves upon the frame structure member along a generally linear path of motion. The user support member moves upon the intermediate support member also along a generally linear path of motion, generally perpendicular to the movement of the intermediate support member upon the frame structure member. A track guide member is mounted upon the frame structure member at a location below the user support member. The user moves the user support member, which operatively engages the track guide member and follows a predetermined path of motion as designated by the track guide member. Different track guide members may be utilized to provide different paths of motion.

13 Claims, 16 Drawing Sheets

(56) References Cited

U.S. PATENT DOCUMENTS

| | | | | |
|---|---|---|---|---|
| 2005/0245367 | A1* | 11/2005 | Horvath | A63B 21/068<br>482/93 |
| 2007/0087921 | A1* | 4/2007 | Graham | A63B 21/055<br>482/132 |
| 2012/0244998 | A1* | 9/2012 | Rao | A63B 71/0054<br>482/70 |
| 2013/0245510 | A1* | 9/2013 | Zaborowski | A61H 1/0237<br>601/33 |

* cited by examiner

MOVING EXERCISE APPARATUS

BACKGROUND OF THE INVENTION

This invention relates to a Moving Exercise Apparatus which has a user support member mounted upon a frame structure member such that the user support member may move relative to the frame structure member along a curved path of motion or a linear path of motion, or both. The user operates the apparatus while in a laying position, and exercises mainly the torso area of the body, although the apparatus may include features which allow other parts of the body to be exercised. A track guide member is mounted beneath the user support member. The user support member operatively engages the track guide member, and it guides the user support member along a path of motion which is defined a grooved pattern in the track guide member. Different track guide members with different groove patterns may be utilized for providing different paths of motion. The ability to guide the user support member along predefined paths of motion makes the apparatus very flexible in that it allows the device to be configured to exercise different muscle groups. Handle members and a leg support member may also be part of the apparatus to assist the user in moving the user support member while also exercise the arms and/or legs.

SUMMARY AND OBJECTS OF THE INVENTION

It is the object of this invention to provide an exercise apparatus which may provide the user an efficient, inexpensive, and flexible means for exercising mainly the torso area of the body. The main purpose of this application is to demonstrate an apparatus which performs the stated function, and to demonstrate the many options and configurations this apparatus may take on.

Briefly stated, the Moving Exercise Apparatus that forms the basis of the present invention comprises a frame structure member, an intermediate support member, a user support member, and a track guide member. The intermediate support member is coupled to the frame support member to move along it in generally linear back and forth motion. The user support member is coupled to the intermediate support member such that it also moves along it in a generally linear back and forth motion. However the motion of the user support member along the intermediate member is perpendicular to the motion of the intermediate support member along the frame structure member. The track guide member is used to guide the user support member along a predefined path of motion.

The user will position himself or herself in a laying position upon the user support member and move the user support member. There may be handle members and a leg support member mounted to the frame structure member that may be used to assist the user in moving the user support member, and for also exercising the arms and/or legs. Otherwise the user would use their feet to move the user support member by pushing their feet against a surface in a back and forth motion. The user support member operative engages the track guide member which is mounted below, and follows a path of motion as defined by a track groove in the track guide member. Since different track guide members may have different track grooves, the device may be customized for an exercise routine which is best suited to the desires of the user. This feature makes the apparatus extremely flexible.

DETAILED DESCRIPTION OF THE PREFERRED EMBODIMENT

Before explaining in detail the present invention, it is to be understood that the invention is not limited in its application to the details of construction or arrangement of parts illustrated in the accompanying drawings, since the invention is capable of other embodiments and of being practiced or carried out in various ways. Also, it is to be understood that the phraseology and terminology employed herein is for the purpose of description, and not limitation.

Figure 1A:
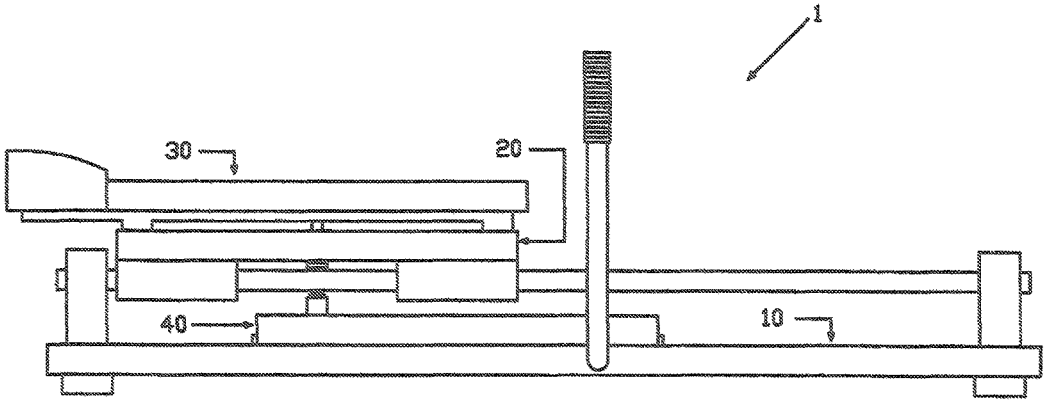
FIG. 1A is a front view of the Moving Exercise Apparatus.
Figure 1B:
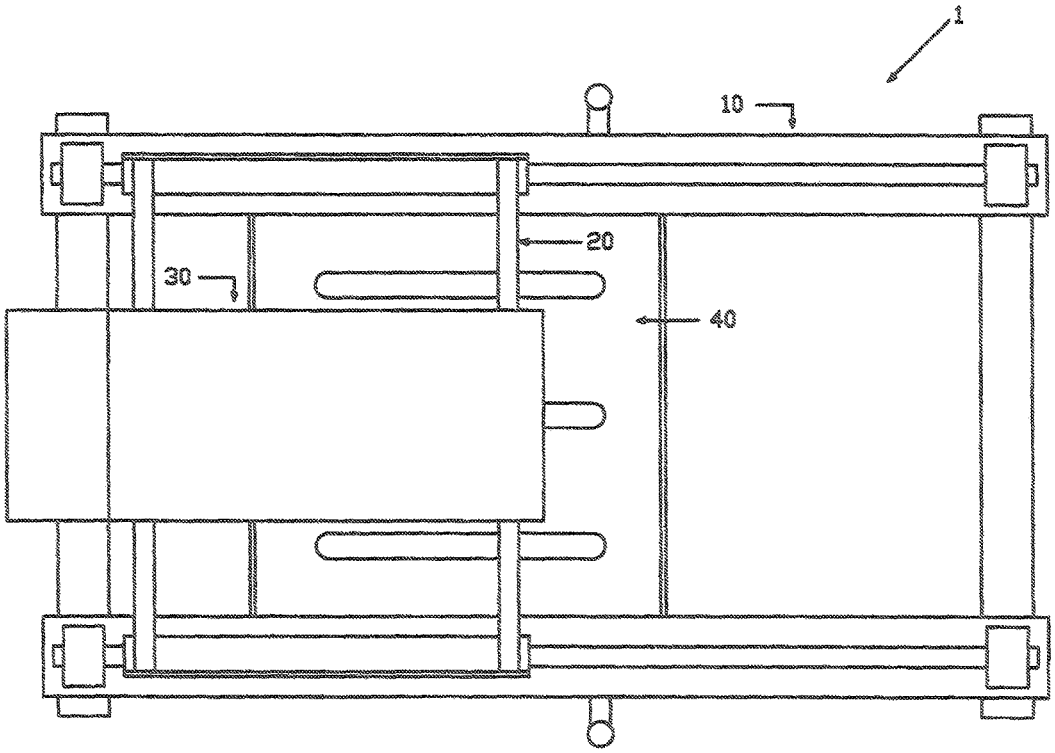
FIG. 1B is a top view of the Moving Exercise Apparatus.
Figure 1C:
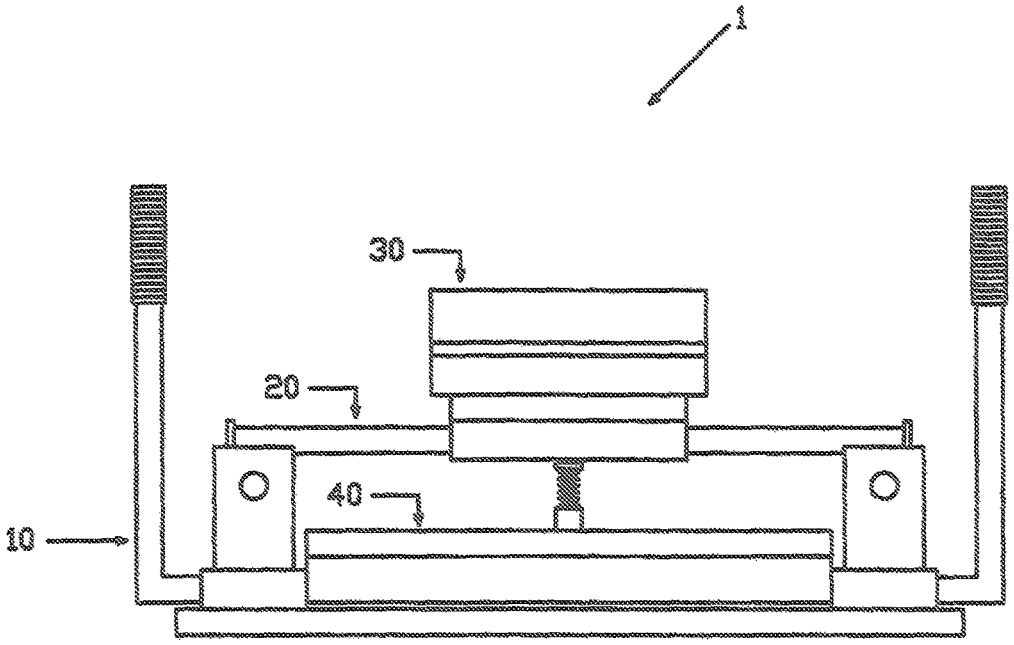
FIG. 1C is a side view of the Moving Exercise Apparatus.

As best can be seen by references to the drawings, and in particular to FIGS. 1A-1C, the Moving Exercise Apparatus that forms the basis of the present invention is designated generally by the reference numeral 1, and includes a frame structure member 10, an intermediate support member 20, a user support member 30, and a track guide member 40. The intermediate support member 20 is coupled to the frame structure member 10 such that it moves back and forth along the frame structure member in a generally linear path of motion. The user support member 30 is coupled to the intermediate support member 20 such that it moves back and forth along the intermediate support member in a generally linear path of motion, but its motion is perpendicular to the motion of the intermediate support member 20 upon the frame support member 10. The user support member 30 operatively engages the track guide member 40.

Figure 2A:
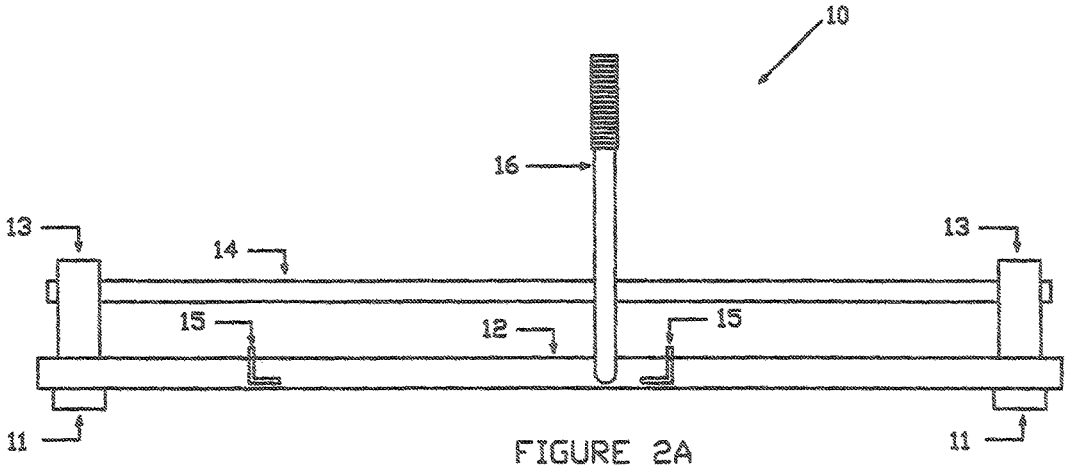
FIG. 2A is a front view of the frame structure member of the Moving Exercise Apparatus.
Figure 2B:
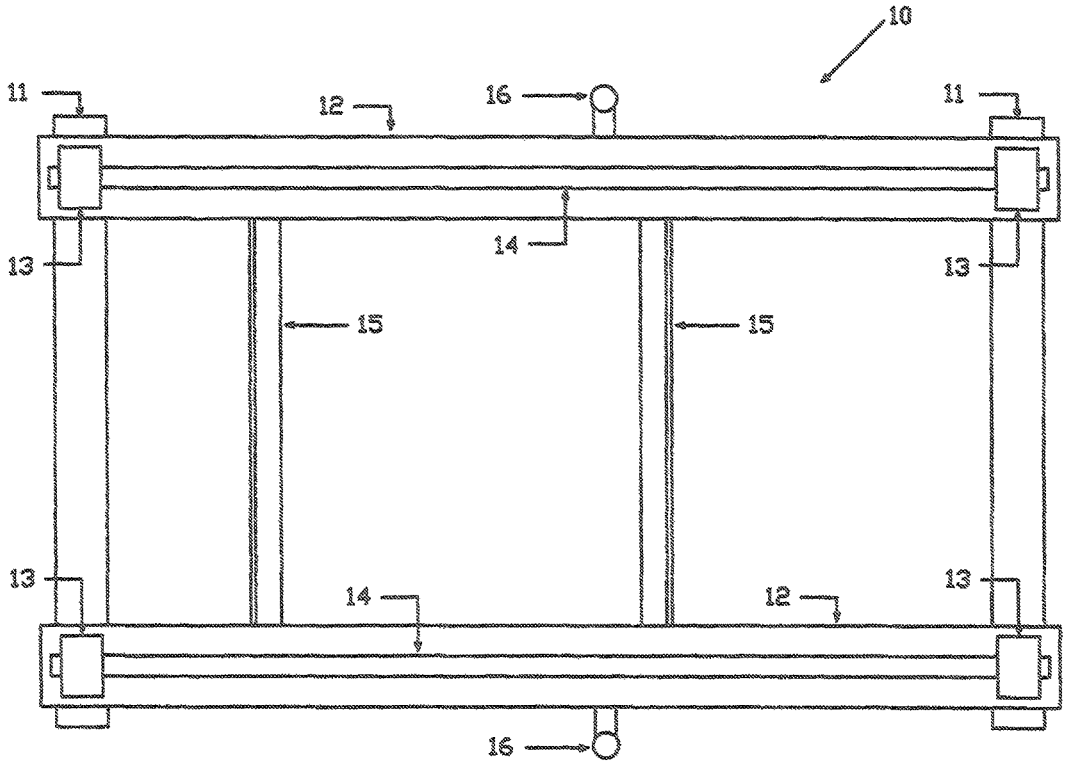
FIG. 2B is a top view of the frame structure member of the Moving Exercise Apparatus.
Figure 2C:
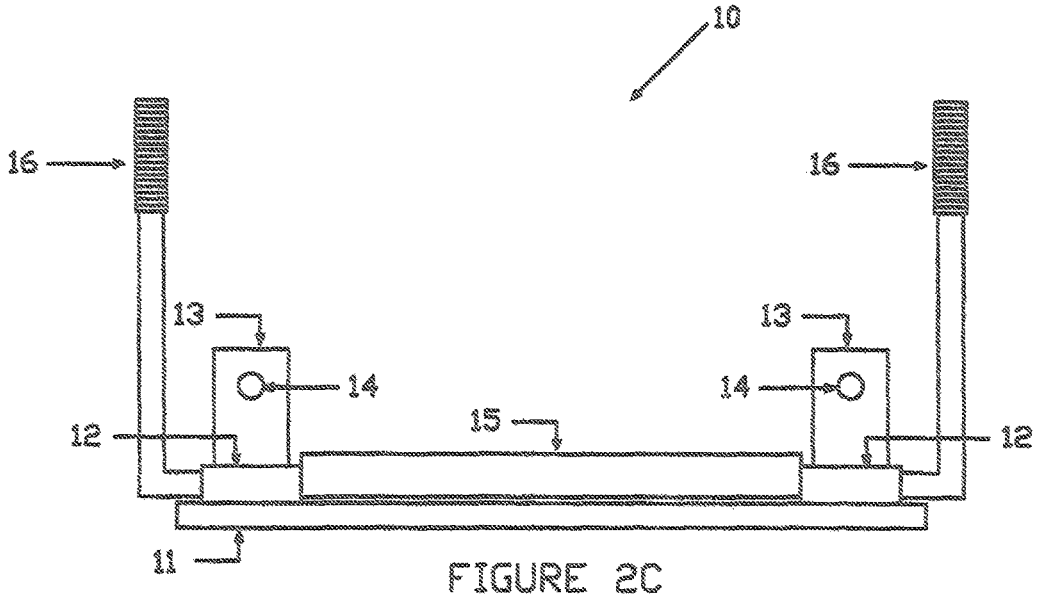
FIG. 2C is a side view of the frame structure member of the Moving Exercise Apparatus.

As may be seen in FIGS. 2A-2C, the frame support member 10 may have generally horizontal base main support members 12 positioned on each side of the apparatus which extend from the front end of the apparatus to the rear end of the apparatus. They are rigidly connected together by generally horizontal base cross support members 11, one at the front end of the apparatus and one at the rear end of the apparatus. Base main support members 12 also have upwardly extending frame guide support members 13 rigidly mounted at each end. These are used to support the frame guide frame guide members 14, which extend from the front end to the rear end of the base main support members 12. There are track guide support members 15 also rigidly mounted to each base main support member 12 which rigidly connect the two base main support members 12 together, as do base cross support members 1. Handle members 16 may also be positioned along both sides of the frame structure member 10 for user engagement.

Figure 3A:
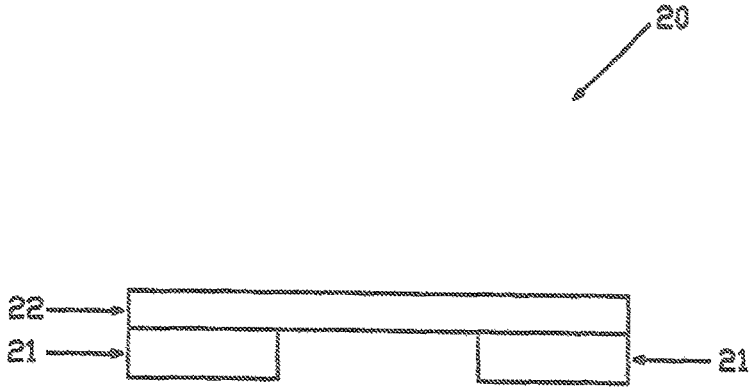
FIG. 3A is a front view of the intermediate support member of Moving Exercise Apparatus.
Figure 3B:
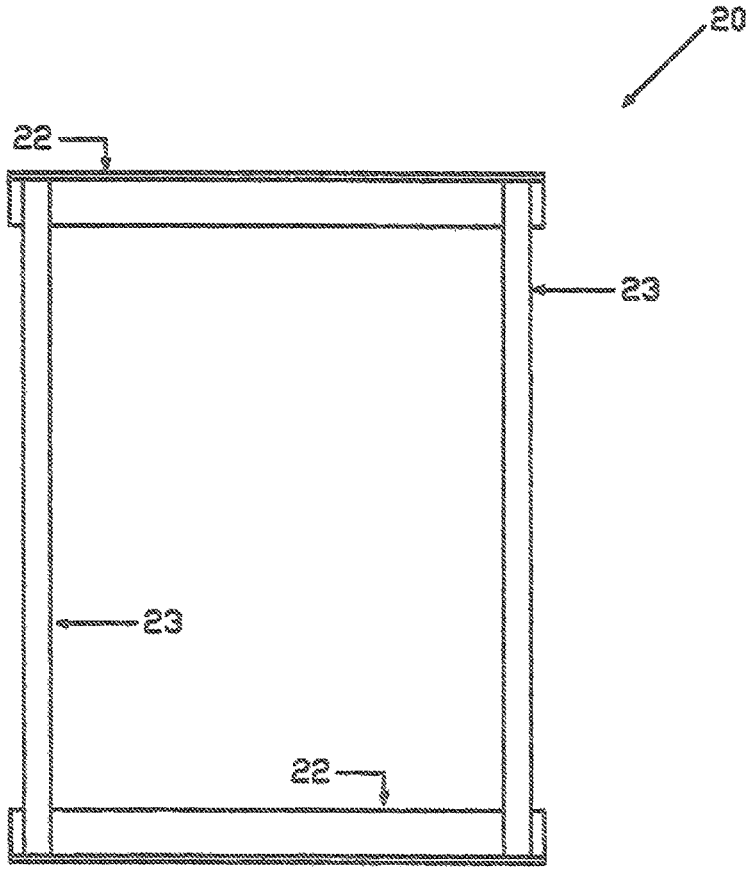
FIG. 3B is a top view of the intermediate support member of Moving Exercise Apparatus.
Figure 3C:
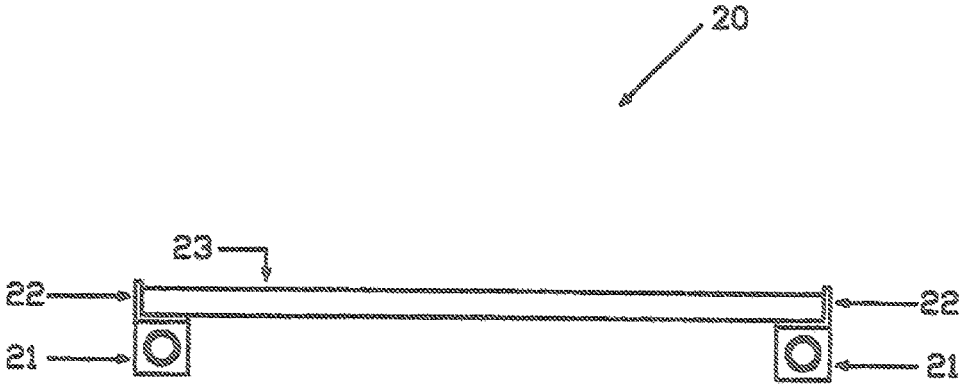
FIG. 3C is a side view of the intermediate support member of Moving Exercise Apparatus.
Figure 4A:
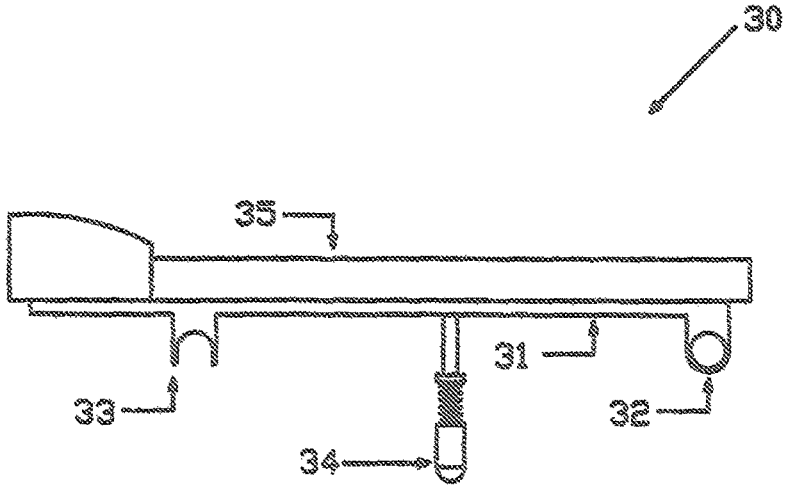
FIG. 4A is a front view of the user support member of Moving Exercise Apparatus.
Figure 4B:
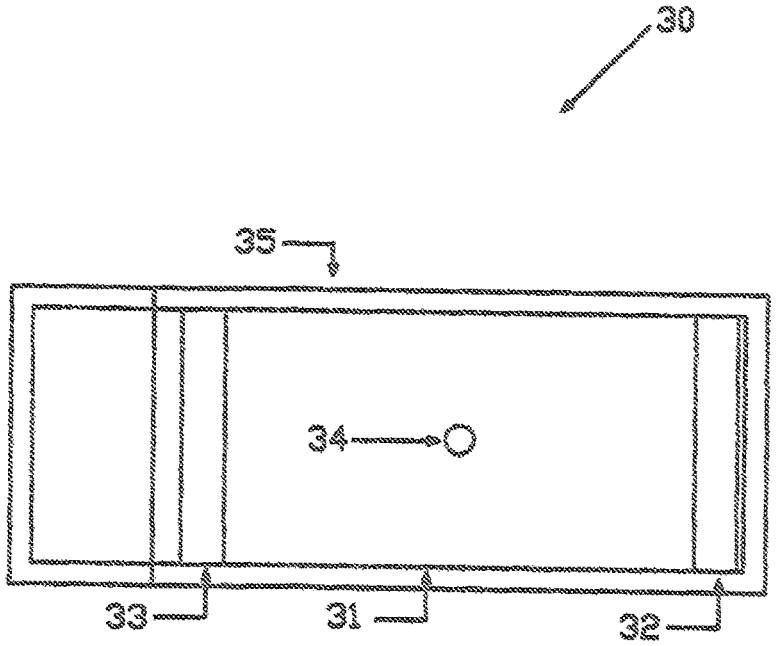
FIG. 4B is a top view of the user support member of Moving Exercise Apparatus.
Figure 4C:
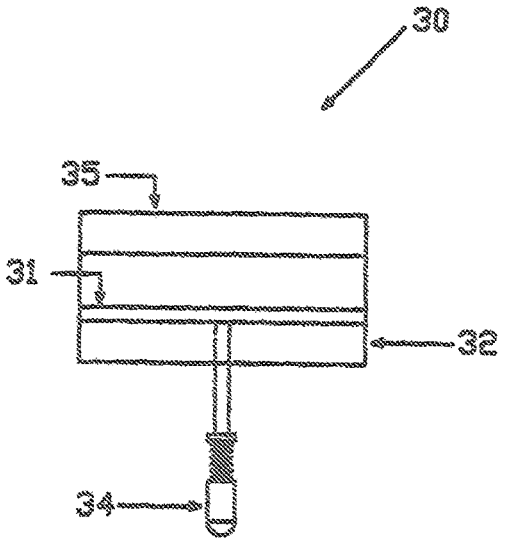
FIG. 4C is a side view of the user support member of Moving Exercise Apparatus.
Figure 4D:
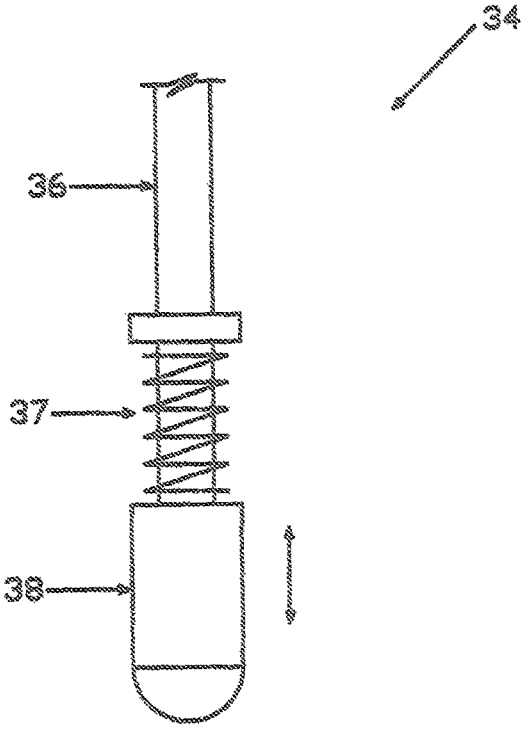
FIG. 4D is a side view of the track engaging member of the user support member of the Moving Exercise Apparatus.

As may be seen in FIGS. 3A-3C, the intermediate support member 20 includes an intermediate coupling member 21, intermediate base support members 22, and intermediate guide members 23. The intermediate coupling members 21 are mounted underneath the intermediate base support members 22 and are used for coupling intermediate support member 20 to the frame guide members located on the sides of the frame structure member. They are coupled such that the intermediate coupling members 21 may move along the frame guide members of the frame structure member in a linear back and forth motion. They may also include bearings which make movement of intermediate support member 20 upon the frame structure member much smoother. Intermediate guide members 23 are rigidly mounted to intermediate base support members 22 at each end so that the intermediate base support members 22 on each side of the apparatus move together. This allows the intermediate support member 20 to move along the frame structure member in a linear back and forth motion The user support member 30 shown in FIGS. 4A-4C comprises a user base support member 31, a first user coupling member 32, a second user coupling member 33, a track engaging member 34, and a primary user support member 35. The first user coupling member 32 is rigidly mounted to the front area of user base support member 31, while the second user coupling member 33 is rigidly mounted to the rear area of user base support member 31. These coupling member are used to moveable couple the user base support member 31 to the intermediate guide members of intermediate support member, such that the user support member 30 moves relative to the frame structure member from one side to the other side. As seen, first coupling member 32 may be constructed with an open bottom area, while second coupling member 33 may be constructed with a closed bottom area. They may also include bearings which make movement of user support member 30 upon the intermediate support member much smoother. Primary user support member 35 mounts to the upper surface of user base support member 31. It is preferably a padded structure upon which the user will lay while operating the apparatus.

FIGS. 4A-4D shows a track engaging member 34 which mounts to the bottom of the user base support member 31. It extends downward from user base support member 31 and comprises a shaft member 36, upon which an engagement member 38 moves upward and downward. A spring member 37 is used to keep the engagement member 38 in a lower position during operation of the apparatus. The lower end of the engagement member 38 preferably has a spherical shape, and may either be a rigid part of the engagement member 38 or may be a type of roller bearing.

Figure 5B:
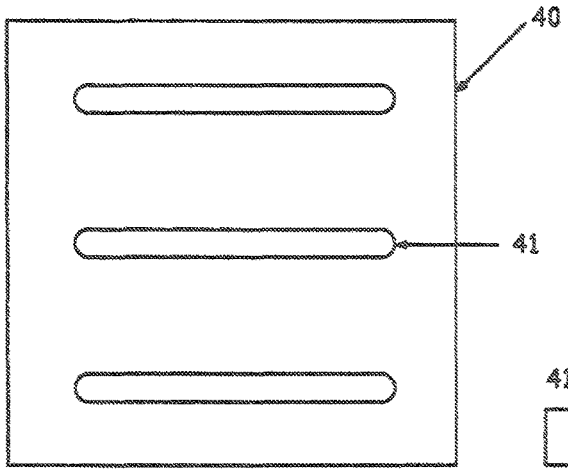
FIG. 5B is a top view of the track guide member of the Moving Exercise Apparatus.
Figure 5D:
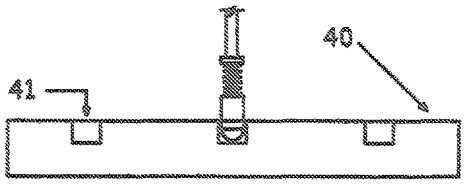
FIG. 5D is another side view of the track guide member of the Moving Exercise Apparatus demonstrating how the track engaging member operatively engages the track grooves of the track guide member.
Figure 5A:
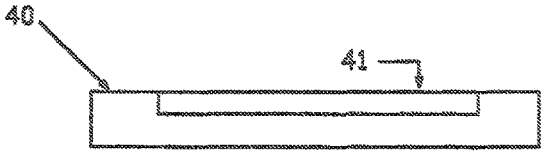
FIG. 5A is a front view of the track guide member of the Moving Exercise Apparatus.
Figure 5C:
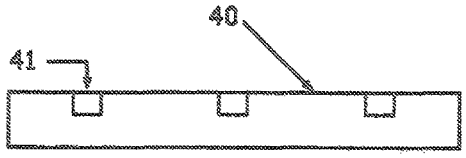
FIG. 5C is a side view of the track guide member of the Moving Exercise Apparatus.
Figures 5E, 5F:
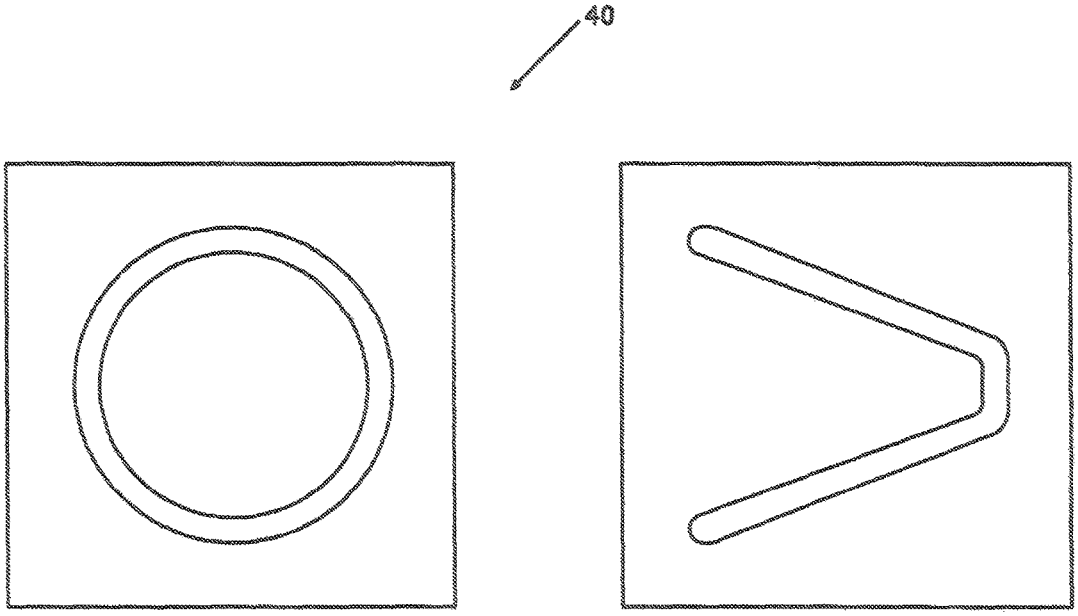
FIGS. 5E, 5F 5G, and 5H are top views of several track guide members of the Moving Exercise Apparatus which have different groove patterns for creating different paths of motion.
Figure 5G:
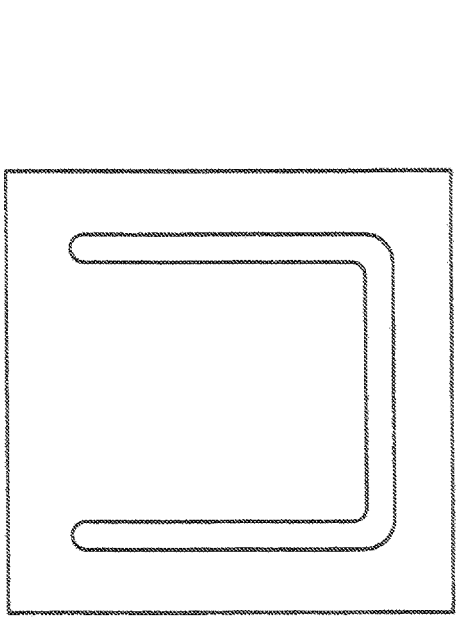
Figure 5H:
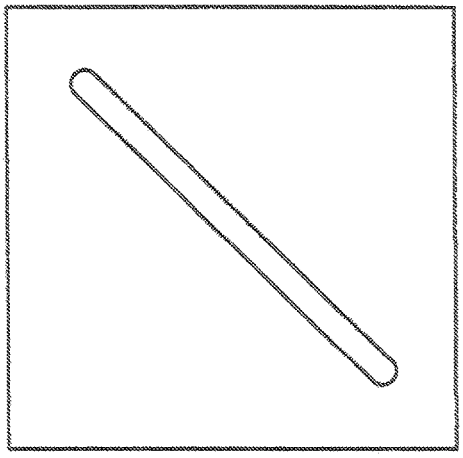

FIGS. 5A-5C shows the track guide member, which mounts upon the track guide support members of the frame structure member at a location below the user support member. The track guide member 40 is a rigid, relatively flat structure with track grooves 41 cut into its top surface. Track grooves 41 may be cut into both the top and bottom surfaces of the track guide member 40 so both sides could be utilized by the apparatus, although for demonstration purposes, the figures only show track grooves 41 cut into the top surface. Having grooves cut into both sides allows the track guide member 40 to be flipped over so that a different set of track grooves 41 may be utilized. FIG. 5D demonstrates how the track engaging member 34 of the user support member 30 interfaces with the track grooves 41 of the track guide member 40.

Figure 5I:
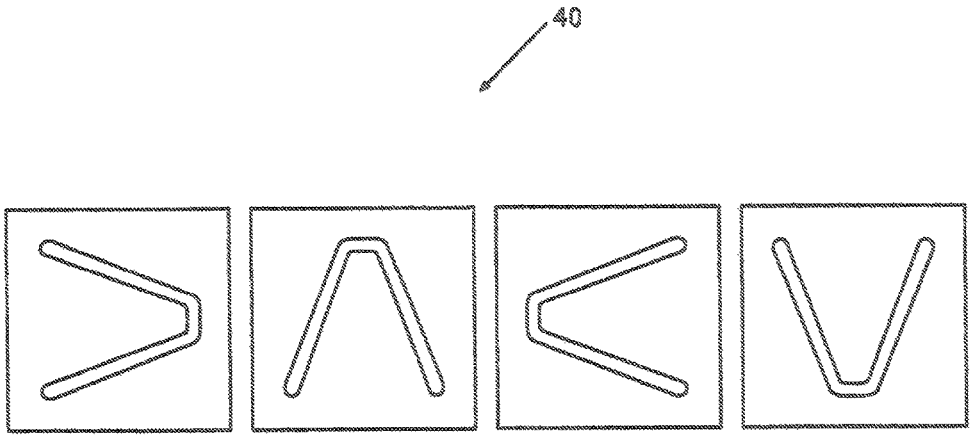
FIG. 5I is a top view of the track guide member of the Moving Exercise Apparatus, demonstrating how the repositioning of the track guide member upon the frame structure member may create relatively different groove patterns, and thus different paths of motion for the user support member.

FIGS. 5E 5F, 5G, and 5H show different groove patterns which may be formed by the track grooves 41. The user support member 30 will be guided along a path of motion which is defined by these grooved patterns. FIG. 5I shows how the track guide member 40 may be positioned in various ways upon the frame structure member to change the path of motion of the user support member 30. As mentioned previously, it may prove desirable to have one type of groove pattern cut into the top surface of track guide member 40, and a different type of groove pattern cut into the bottom surface of track guide member 40. This would allow the track guide member to be turned over, with a different groove pattern utilized by the apparatus. This would cut down on the total number of track guide members 40 needed, since one track guide member 40 would have two different groove patterns defined by the track grooves.

Figure 6A:
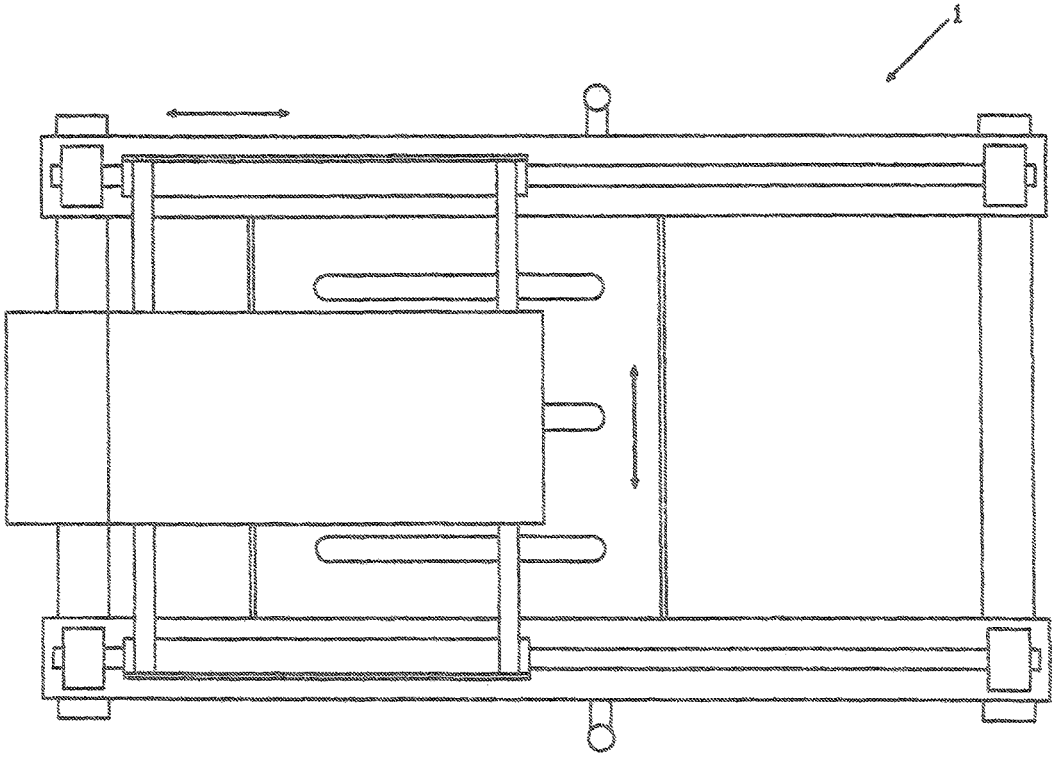
FIGS. 6A and 6B are top views of the Moving Exercise Apparatus demonstrating how the user support member moves relative to the frame structure member.
Figure 6B:
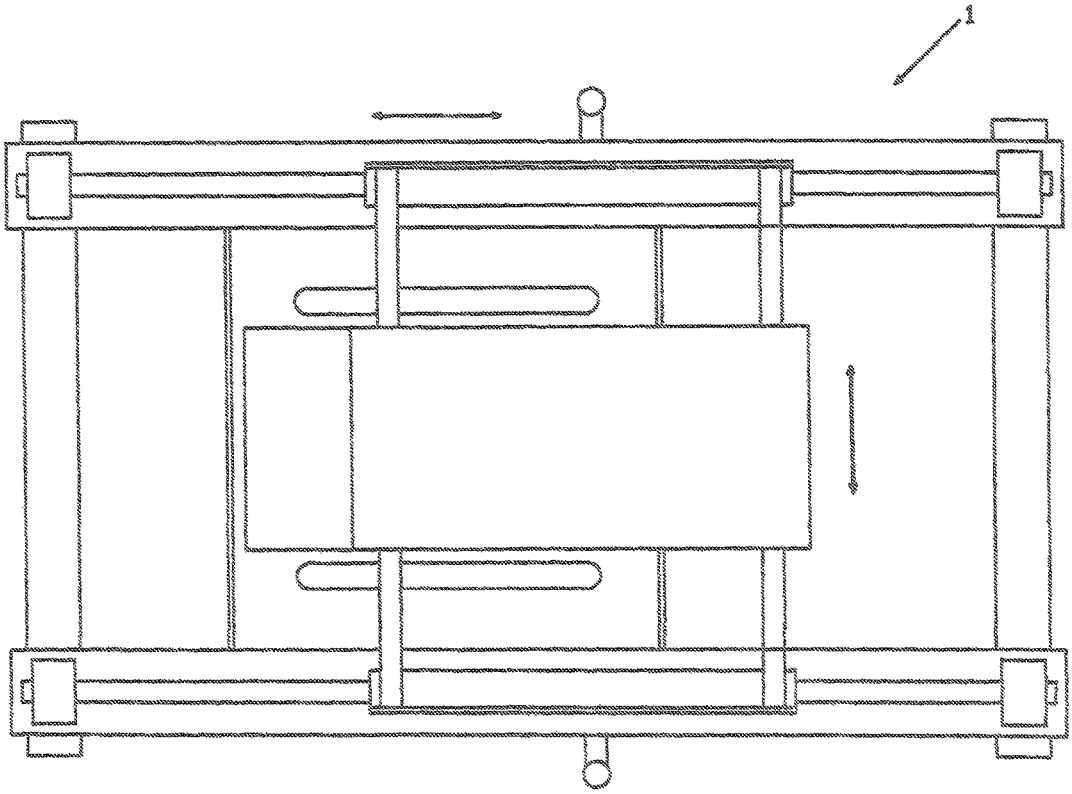

FIGS. 6A and 6B demonstrate how the Moving Exercise Apparatus operates. As shown, the track guide member is securely placed upon the track guide support members of the frame structure member, with the track engaging member of the user support being placed into the track groove of the track guide member. The user will position himself or herself in a laying position upon the user support member, with the feet of the user normally resting on a surface which is past the rear area of the apparatus. The user may thus utilize their feet, and/or the handle members, to move the user support member. As previously mentioned, the intermediate support member moves in a front to rear motion upon the frame structure member, while the user support member moves in a side to side direction upon the intermediate support member, with respect to the frame structure member. This feature allows the user support member to move relative to the frame structure member in a manner as defined by the track groove in the track guide member. In this example, the motion is linear, from the center front to the center rear, relative to the frame structure member. The user support member could be repositioned to utilize the track groove to the right or left. The user support member would still move from front to rear relative to the frame structure member, but not in the center. This particular track guide member could be repositioned such that the groove patterns extend from side to side and not front to rear. In this new configuration, the user support member would move in the side to side direction, with respect to the frame structure member, and not in the front to rear direction. As seen in the previous figures, the relative movement of the user support member with respect to the frame structure member may be linear, curved, or a combination of both, as determined by the groove pattern in the track guide member.

Figure 7:
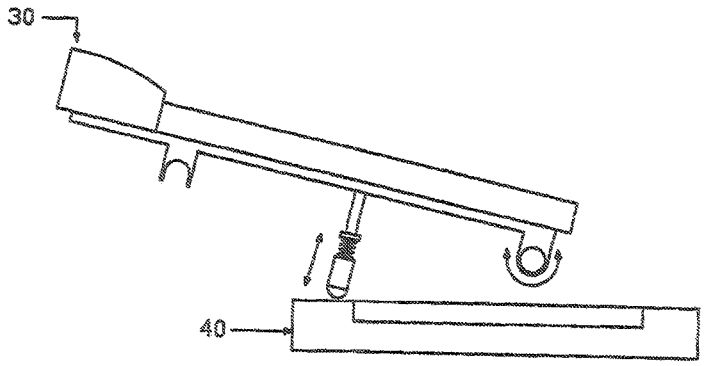
FIG. 7 is a side view of the user support member and track guide member of the Moving Exercise Apparatus, demonstrating how the track engaging member of the user support member adjust so that it may be easily placed within the track grooves of the track guide member

FIG. 7 demonstrates how the user support member 30 may be repositioned to utilize different track guide members 40. As mentioned previously, the first coupling member 32 may be constructed with an open bottom area, while second coupling member 33 may be constructed with a closed bottom area. This allows the user support member 30 to pivot about the intermediate guide member of the intermediate support member upon which the second coupling member 33 mounts. The user support member 40 may be pivoted upward, to allow a different track guide member to be placed underneath. The user support member 40 may then be pivoted back downward, with the track engaging member of the user support member adjusting itself as it comes into contact with the track guide member, until it rest inside the track guide groove.

Figure 8A:
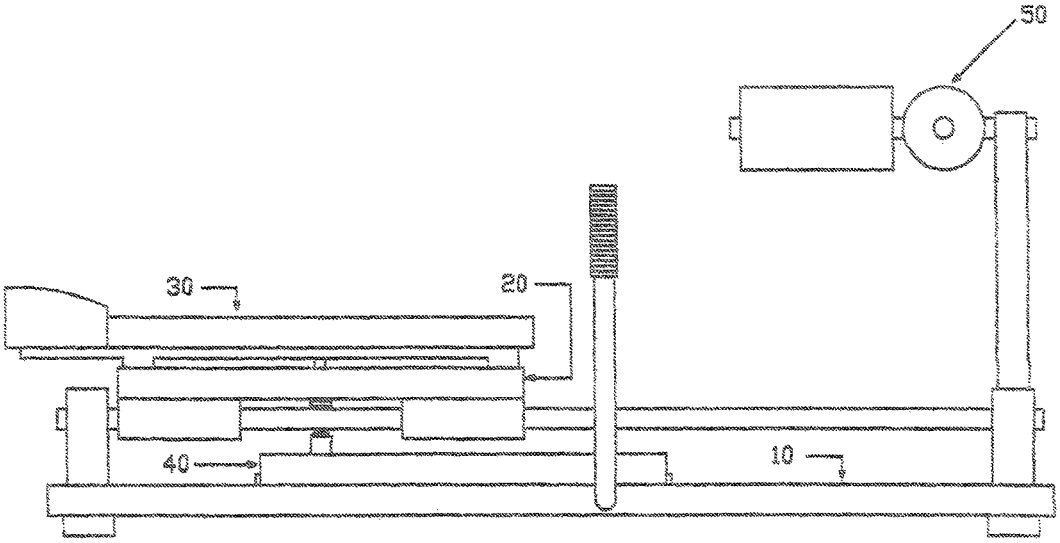
FIG. 8A is a front view of the optional leg support member of the Moving Exercise Apparatus.
Figure 8B:
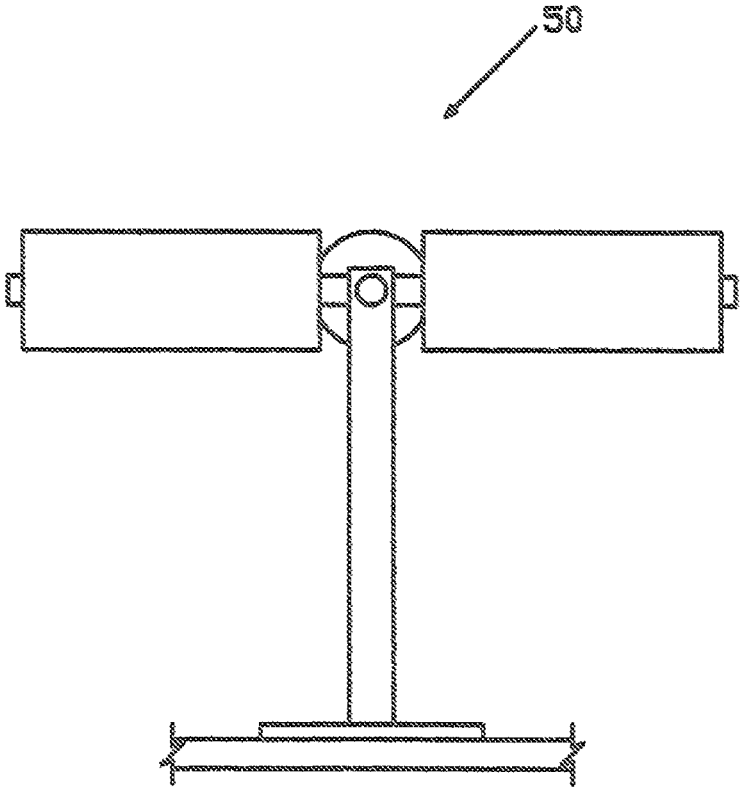
FIG. 8B is a side view of the optional leg support member of the Moving Exercise Apparatus.

FIGS. 8A and 8B show an optional leg support member 50 which may be attached to the rear end of the apparatus. It can be used by the legs of the user to move the user support member along its path of motion. It can be used in conjunction with the handle members, or by itself. The handle members and leg support member allows the user to exercise other muscles groups besides those in the torso area. The handle members may be used to also exercise the arms, while the leg support member may be used to also exercise the legs. As mentioned previously, the may be used together or individually.

Conventional resistance devices may also be part of the apparatus to create resistance in the movement of the user support member. Also, the frame structure member may be constructed so that the apparatus operates at an angle. Weights may also be added to the user support member to provide resistance to motion of the user support member. In the apparatus described, the intermediate support member moves from the front of the apparatus to the rear of the apparatus, while the user support member moves along the intermediate support member from one side to the other side, with respect to the frame structure member. An apparatus may be constructed in which the intermediate support member moves from one side of the apparatus to the other side, while the user support member moves along the intermediate support member from the front of the apparatus to the rear of the apparatus.

Many variations of the moving exercise apparatus exist, along with the configurations described above. While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A Motion Exercise Apparatus comprising:

a frame structure member;

an intermediate support member coupled to said frame structure member such that said intermediate support member travels along said frame structure member in a generally linear path of motion;

a user support member coupled to said intermediate support member such that said user support member travels along said intermediate support member in a generally linear path of motion, said generally linear path of motion being generally perpendicular to the generally linear path of motion of said intermediate support member along said frame structure member;

a track guide member positioned upon said frame structure member at a location beneath said user support member, said user support member operatively engaging said track guide member such that said track guide member guides both said intermediate support member and said user support member along their respective said paths of motion; said user support member further comprising a track engaging member extending in a generally downward direction;

said track guide member having at least one track groove which operatively engage said track engaging member of said user support member, such that said intermediate support member and said user support member is configured to move along a path of motion designated by said track groove of said track guide member, allowing said user support member to follow a generally curved path of motion or a generally linear path of motion as defined by said track groove;

whereby the apparatus is configured for a user to position themselves in a generally laying position upon said user support member and move said user support member along its said generally linear path of motion, such that said user support member is configured to also move said intermediate support member along its said generally linear path of motion, said generally linear paths of motion of said user support member and said intermediate support member being determined by said track guide member.

2. The Motion Exercise Apparatus as claimed in claim 1, said frame structure member comprising a base frame member having a front end and a rear end; frame guide members mounted to said base frame member and extending from said front end of said base frame member to said rear end of said base frame member, said intermediate support member coupled to said frame guide members such that said intermediate support member moves along said frame structure member in a generally linear back and forth motion between said front end and said rear end of said base frame member.

3. The Motion Exercise Apparatus as claimed in claim 2, said intermediate support member comprising intermediate base support members, each having an intermediate coupling member mounted thereon for movably coupling said intermediate base support member to each of said frame guide members of said frame structure member; and intermediate guide members rigidly connecting said intermediate base support members such that said intermediate coupling members move simultaneous with one another, said intermediate guide members of said intermediate support member being mounted generally perpendicular to said frame guide members of said frame structure member.

4. The Motion Exercise Apparatus as claimed in claim 3, said user support member comprising a user base support member having user coupling members mounted thereon for moveably coupling said user base support member to said intermediate guide members of said of said intermediate support member; and a primary user support member mounted to said user base support member for directly supporting said user while in a relatively laying position.

5. The Motion Exercise Apparatus as claimed in claim 1, said frame structure member further comprising handle members mounted thereon configured to allow said user to more easily move the user support member while in the laying position.

6. The Motion Exercise Apparatus as claimed in claim 1, said frame structure member further comprising leg support members mounted to the rear end of said base frame member of said frame structure member configured to allow said user to more easily move the user support member while in the laying position.

7. A Motion Exercise Apparatus comprising:

a frame structure member comprising frame guide members;

an intermediate support member coupled to said frame structure member such that said intermediate support member travels along said frame structure member in a generally linear path of motion;

said intermediate support member comprising intermediate base support members, each having an intermediate coupling member mounted thereon for movably coupling said intermediate base support member to each of said frame guide members of said frame structure member; and intermediate guide members rigidly connecting said intermediate base support members such that said intermediate coupling members move simultaneous with one another, said intermediate guide members of said intermediate support member being mounted generally perpendicular to said frame guide members of said frame structure member;

a user support member coupled to said intermediate support member such that said user support member travels along said intermediate support member in a generally linear path of motion, said generally linear path of motion being generally perpendicular to the generally linear path of motion of said intermediate support member along said frame structure member; said user support member further comprising a track engaging member extending in a generally downward direction;

said user support member comprising a user base support member having user coupling members mounted thereon for moveably coupling said user base support member to said intermediate guide members of said intermediate support member; and a primary user support member mounted to said user base support member for directly supporting a user while in a generally laying position;

a track guide member having a track groove and being positioned upon said frame structure member at a location beneath said user support member, said track engaging member of said user support member operatively engaging said track groove of said track guide member;

whereby the apparatus is configured for said user to position themselves in a generally laying position upon said user support member and move said user support member, relative to said frame structure member, along a path of motion as defined by said track groove of said track guide member.

8. The Motion Exercise Apparatus as claimed in claim 7, said frame structure member comprising a base frame member having a front end and a rear end; said frame guide members mounted to said base frame member and extending from said front end of said base frame member to said rear end of said base frame member, said intermediate support member coupled to said frame guide members such that said intermediate support member moves between said front end and said rear end of said base frame structure in a generally linear back and forth motion.

9. The Motion Exercise Apparatus as claimed in claim 7, said frame structure member further comprising handle members mounted thereon configured to allow said user to more easily move said user support member while in the laying position.

10. The Motion Exercise Apparatus as claimed in claim 7, said frame structure member further comprising leg support members mounted to the rear end of said base frame member of said frame structure member configured to allow said user to more easily move said user support member while in the laying position.

11. A Motion Exercise Apparatus comprising:

a frame structure member, said frame structure member comprising a base frame member having a front end and a rear end; and frame guide members mounted to said base frame member and extending from said front end of said base frame member to said rear end of said base frame member;

an intermediate support member comprising intermediate base support members, each having an intermediate coupling member mounted thereon for movably coupling said frame guide members of said intermediate base support member; and intermediate guide members rigidly connecting said intermediate base support members such that said intermediate coupling members move simultaneous with one another, said intermediate guide members of said intermediate support member being mounted generally perpendicular to said frame guide members of said frame structure member;

a user support member comprising a user base support member having user coupling members mounted thereon for moveably coupling said user base support member to said intermediate guide members of said of said intermediate support member; and a primary user support member mounted to said user base support member for directly supporting a user while in a generally laying position; and a track engaging member extending in a generally downward direction;

a track guide member having a track groove and being positioned upon said frame structure member at a location beneath said user support member, said track engaging member of said user support member operatively engaging said track groove of said track guide member;

whereby the apparatus is configured for a user to position themselves in a generally laying position upon said user support member and move said user support member such that said intermediate support member moves between said front end and said rear end of said base frame structure in a generally linear back and forth motion, and such that said user support member travels along said intermediate support member in a generally linear path of motion which is generally perpendicular to the generally linear path of motion of said intermediate support member, said movement of said user support member relative to frame structure member being defined by said track groove of said track guide member.

12. The Motion Exercise Apparatus as claimed in claim 11, said frame structure member further comprising handle members configured to allow said user to more easily move said user support member while in the laying position.

13. The Motion Exercise Apparatus as claimed in claim 11, said frame structure member further comprising leg support members mounted to the rear end of said base frame member of said frame structure member configured to allow said user to more easily move said user support member while in the laying position.

* * * * *